US009840076B2

(12) United States Patent
Okui et al.

(10) Patent No.: US 9,840,076 B2
(45) Date of Patent: Dec. 12, 2017

(54) LIQUID EJECTING HEAD AND LIQUID EJECTING APPARATUS

(71) Applicant: SEIKO EPSON CORPORATION, Tokyo (JP)

(72) Inventors: Hiroaki Okui, Azumino (JP); Takayuki Shimosaka, Matsumoto (JP); Naoya Sato, Chino (JP); Hitoshi Takaai, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 19 days.

(21) Appl. No.: 14/817,397

(22) Filed: Aug. 4, 2015

(65) Prior Publication Data

US 2016/0031214 A1 Feb. 4, 2016

(30) Foreign Application Priority Data

Aug. 4, 2014 (JP) ..... 2014-159063
Aug. 4, 2014 (JP) ..... 2014-159064

(51) Int. Cl.
*B41J 2/14* (2006.01)
*B41J 2/21* (2006.01)

(52) U.S. Cl.
CPC ..... *B41J 2/14* (2013.01); *B41J 2/14233* (2013.01); *B41J 2/2146* (2013.01); *B41J 2002/14362* (2013.01); *B41J 2002/14419* (2013.01); *B41J 2002/14491* (2013.01); *B41J 2202/20* (2013.01)

(58) Field of Classification Search
CPC ..... B41J 2002/1425; B41J 2002/14258; B41J 2002/14266; B41J 2002/14491; B41J 2/1612; B41J 2202/08
See application file for complete search history.

(56) References Cited

U.S. PATENT DOCUMENTS

2003/0067510 A1* 4/2003 Isono ..... B41J 2/14209 347/68
2009/0244186 A1* 10/2009 Ito ..... B41J 2/055 347/50
2013/0241996 A1* 9/2013 Hara ..... B41J 2/14201 347/40

FOREIGN PATENT DOCUMENTS

JP 2006-346867 A 12/2006
JP 2011-067998 A 4/2011
JP 2013-103429 A 5/2013

* cited by examiner

*Primary Examiner* — Kristal Feggins
*Assistant Examiner* — Kendrick Liu
(74) *Attorney, Agent, or Firm* — Workman Nydegger

(57) ABSTRACT

A liquid ejecting head includes driving elements and electrodes each extending a second direction for ejecting liquid of pressure chambers through nozzles. The driving elements are classified into a first element group and a second element group. The electrodes are arranged along a first direction intersecting the second direction and are classified into a first electrode group electrically connected to the first element group, a second electrode group electrically connected to the second element group and a third electrode group not contribute to the ejecting liquid.

20 Claims, 11 Drawing Sheets

LIQUID EJECTING HEAD AND LIQUID EJECTING APPARATUS

CROSS-REFERENCE TO RELATED APPLICATIONS

This application claims priority to Japanese Patent Application No. 2014-159063 filed on Aug. 4, 2014 and Japanese Patent Application No. 2014-159064 filed on Aug. 4, 2014. The entire disclosures of Japanese Patent Application Nos. 2014-159063 and 2014-159064 are hereby incorporated herein by reference.

BACKGROUND

1. Technical Field

The present invention relates to a technique for ejecting liquid such as ink.

2. Related Art

Various techniques for ejecting liquid such as ink onto a medium such as printing paper are proposed in the related art. For example, JP-A-2013-103429 discloses a liquid ejecting head which causes ink inside a pressure chamber to be ejected from a nozzle by driving each of a plurality of piezoelectric elements that are arranged in two rows of a first row and a second row. A plurality of electrodes (connection terminals) for electrically connecting the plurality of piezoelectric elements to wirings on a flexible wiring board (flexible cable) are formed in a region between the first row and the second row (hereinafter referred to as a "mounting region").

It is possible to arrange the plurality of piezoelectric elements in various aspects according to a nozzle position that corresponds to each piezoelectric element. Meanwhile, each of the plurality of electrodes within the mounting region are formed at a position corresponding to each piezoelectric element. Accordingly, for example, if a configuration is assumed where the position in the arrangement direction of the piezoelectric elements is made different for the first row and the second row, in a region in which the first row and the second row of the piezoelectric elements overlap with one another in the mounting region, there is a configuration in which electrodes that are connected to each of the piezoelectric elements of the first row and electrodes that are connected to each of the piezoelectric elements of the second row are mixed, in a region at an end section side of the mounting region, electrodes that are connected to each of the piezoelectric elements of only one of the first row or the second row are present, and so the density of the electrodes is different in each region within the mounting region.

However, it is possible for various problems caused by the densities of the electrodes within the mounting region to occur. For example, the degree of flow of an adhesive differs according to the densities of the electrodes within the mounting region in the process of mounting components of wiring boards or the like using an adhesive within the mounting region, and it is possible for a problem resulting in adhesion failure or the like to occur. Alternatively, for example, in a case where a liquid ejecting head is heated in the manufacturing process, it is possible that biasing in heat distribution within the mounting region occurs according to the densities of the electrodes within the mounting region and non-uniformity of characteristics of the components formed hereafter is caused.

SUMMARY

An advantage of some aspects of the invention is to uniformize the densities of electrodes within the mounting region.

According to an aspect of the invention, there is provided a liquid ejecting head including: a plurality of driving elements which cause liquid to be ejected from nozzles by imparting pressure to a pressure chamber in which the liquid is filled, the plurality of driving elements including a plurality of first driving elements which are arranged along a first direction and a plurality of second driving electrodes which are arranged along the first direction at the opposite side to the plurality of first driving elements with a mounting region, in which a mounting component is installed, interposed therebetween; and a plurality of electrodes which are formed in the mounting region so as to extend along the second direction which intersects with the first direction, in which the plurality of electrodes include: a plurality of first electrodes which are arranged along the first direction in a first region within the mounting region and are electrically connected to the plurality of first driving elements; a plurality of second electrodes which are arranged along the first direction across the first region within the mounting region and a second region within the mounting region which is positioned at one side in the first direction viewed from the first region, and are electrically connected to the plurality of second driving elements; and a third electrode which does not contribute to ejection of the liquid and is formed between each of the second electrodes that are adjacent to one another along the first direction in the second region. In the above aspect, in the configuration where the first electrodes and the second electrodes are formed in the first region and the second electrodes are formed in the second region of the mounting region, the third electrodes that do not contribute to ejection of liquid are formed between each of the second electrodes which are adjacent to one another along the first direction within the second region. Accordingly, in comparison to the configuration where the third electrodes are not formed in the second region, the difference in density of the electrodes between the first region and the second region is reduced. That is, it is possible to uniformize density of the electrodes within the mounting region. According to a configuration where the numerical values of a pitch where the first electrodes and the second electrodes are arranged within the first region and a pitch where the second electrodes and third electrodes are arranged in the second region are equal, the effect in which it is possible to uniformize the densities of the electrodes within the mounting region is particularly remarkable.

Here, the "third electrodes do not contribute to ejection of liquid" has the meaning of, for example, so-called dummy electrodes which include electrodes that are not electrically connected to the driving elements, electrodes that are electrically connected to an ineffective driving element that does not contribute to ejection of liquid, and the like. The ineffective driving element is the same as a component configured by an effective driving element that contributes to ejection of liquid where a section is defective (that is, an element which does not actually operate) or a driving element where the structure of the driving element is effective (accordingly, actually operating due to supply of an electrical signal), but includes a driving element which is arranged corresponding to a flow path that reaches externally that is blocked at an arbitrary location (for example, a flow path where the nozzle furthest downstream is blocked or a flow path where a middle location is blocked).

Here, based on the configuration where a flexible wiring board on which a plurality of connection terminals, which are electrically connected to the plurality of first electrodes and plurality of second electrodes, are formed is set as an electric wiring (e.g. a mounting component) and fixed using an adhesive, in a case where the densities of the electrodes in the first region and the second region are different, it is possible that the optimal coating amount and flow amount of the adhesive are different in the first region and the second region, therefore it is possible that a problem such as insufficient adhesive strength or positional error of the wiring board manifests. Accordingly, the invention in which it is possible to uniformize densities of the electrodes within the mounting region is particularly effective in a case where the flexible wiring board is set as the mounting component and is fixed using an adhesive. In particular, in a configuration provided with a structure that includes a first wall surface positioned between the mounting region and a plurality of first driving elements and a second wall surface positioned between the mounting region and the second driving elements, it is possible for an error to occur at a position on the wiring board due to stress from the adhesive resulting from an excess of adhesive blocking the first wall surface and the second wall surface. The invention where it is possible to uniformize densities of the electrodes within the mounting region is particularly preferable in a configuration where a structure including the first wall surface and the second wall surface is installed.

In the aspect of the invention, a plurality of third electrodes are arranged at a first pitch along the first direction at an opposite side to the first region in the second region. In the aspect above, in addition to the third electrodes being formed in a region where the second electrodes are formed in the second region, a plurality of electrodes are arranged at the first pitch at an opposite side to the first region in the second region. Accordingly, it is advantageous in that it is possible to uniformize densities of electrodes across a wide range including a region where the second electrodes are not present in the second region.

In a configuration where each of the plurality of driving elements includes a first driving electrode, a piezoelectric body which is formed on an upper surface of the first driving electrode in a process including heat treatment, and a second driving electrode which is formed on an upper surface of the piezoelectric body, the first electrode is electrically connected to the first driving electrode of the first driving element, and the second electrode is electrically connected to the first driving electrode of the second driving element, in a heat treatment process in which a piezoelectric body is formed, it is possible that biasing in heat distribution occurs according to the presence or absence of the first electrodes and that a problem such as film formation failure of the piezoelectric body is caused. Considering the circumstances above, the liquid ejecting head according to the aspect of the invention includes fourth electrodes that are formed on the same layer as the first driving electrodes at an opposite side to another end section that interposes one end section in an array of the plurality of first driving elements. In the above aspect, since the fourth electrodes are formed on the same layer as the first driving electrodes at the opposite side to the other end section that interposes the one end section in an array of the plurality of first driving elements, biasing in heat distribution between the region in which the first driving elements are arranged and another region is reduced. Accordingly, it is possible to eliminate the problem such as film formation failure of a piezoelectric body of each driving element. As a result of the above, an interval between the first driving electrode of the first driving element and the first driving electrode of the second driving element is particularly remarkable in a wide configuration in comparison to the range in which the fourth electrodes are distributed along the first direction.

In the aspect of the invention, the range in which the first electrodes are present along the second direction and the range in which the second electrodes are present along the second direction overlap with one another in the second direction. In the above aspect, the range in which the first electrodes are present along the second direction and the range in which the second electrodes are present along the second direction overlap, therefore in a simple process in which mounting components are installed within the range of overlapping, it is possible to connect the first electrodes and the second electrodes with respect to the mounting components.

In the aspect of the invention, a virtual line that links a nozzle corresponding to a first driving element which is positioned at an end section at one side in the first direction among the plurality of first driving elements and a nozzle corresponding to a second driving element which is positioned at an end section at one side in the first direction among the plurality of second driving elements is inclined at an angle within the range of 30° to 60° inclusive in the first direction (further preferably, within the range of 30° to 40° inclusive, or 50° to 60° inclusive). In the above aspect, since the virtual line and the first direction are inclined to one another, in comparison, for example, to a configuration where a plurality of nozzles are arranged in a direction perpendicular to the first direction, it is possible to increase the dot density (resolution) in the direction.

A liquid ejecting apparatus according to another aspect of the invention includes the liquid ejecting head according to each of the above aspects. A printing apparatus which ejects ink is a preferred example of the liquid ejecting head, but the applications of the liquid ejecting apparatus according to the invention are not limited thereto.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
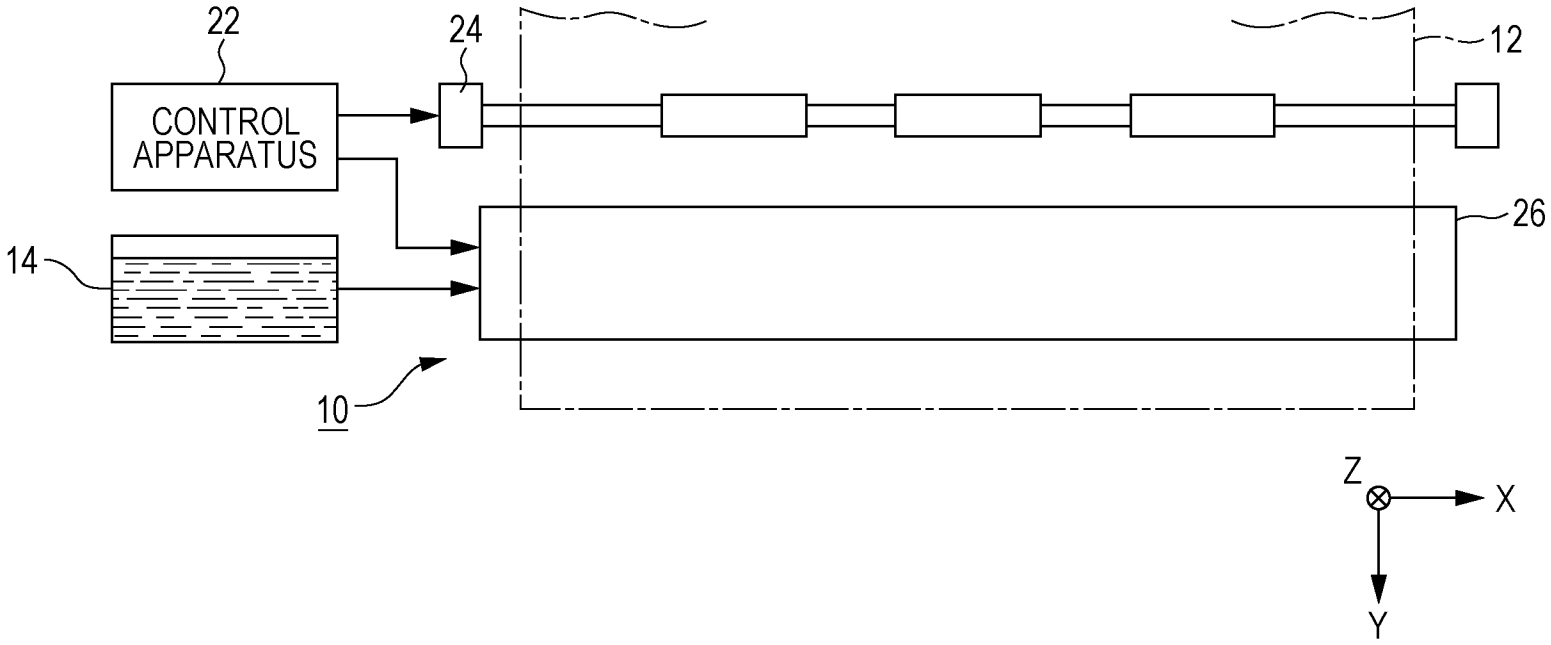
FIG. 1 is a configuration diagram of a printing apparatus according to a first embodiment of the invention.

FIG. 1 is a partial configuration diagram of an ink jet type printing apparatus 10 according to a first embodiment of the invention. The printing apparatus 10 of the first embodiment is a liquid ejecting apparatus which ejects ink, which is an exemplification of a liquid, onto a medium 12 (ejection target) such as printing paper and includes a control device 22, a transport mechanism 24, and a liquid ejecting module 26. A liquid container (cartridge) 14 which retains ink of a plurality of colors is mounted in the printing apparatus 10. In the first embodiment, ink of four colors: cyan (C); magenta (M); yellow (Y); and black (B) is retained in the liquid container 14.

The control device 22 collectively controls each of the components of the printing apparatus 10. The transport mechanism 24 transports the medium 12 in the Y direction under control by the control device 22. The liquid ejecting module 26 ejects ink supplied from the liquid container 14 onto the medium 12 under control by the control device 22. The liquid ejecting module 26 of the first embodiment is a line head with a long dimension in the X direction that intersects with (typically orthogonal to) the Y direction. A desired image is formed on the surface of the medium 12 by the liquid ejecting module 26 ejecting ink onto the medium 12 in parallel with transport of the medium 12 by the transport mechanism 24. Here, a direction which is perpendicular to the X-Y horizontal plane (the horizontal plane which is parallel to the surface of the medium 12) is represented below as the Z direction. The ejection direction of ink by the liquid ejecting module 26 is equivalent to the Z direction.

Figure 2:
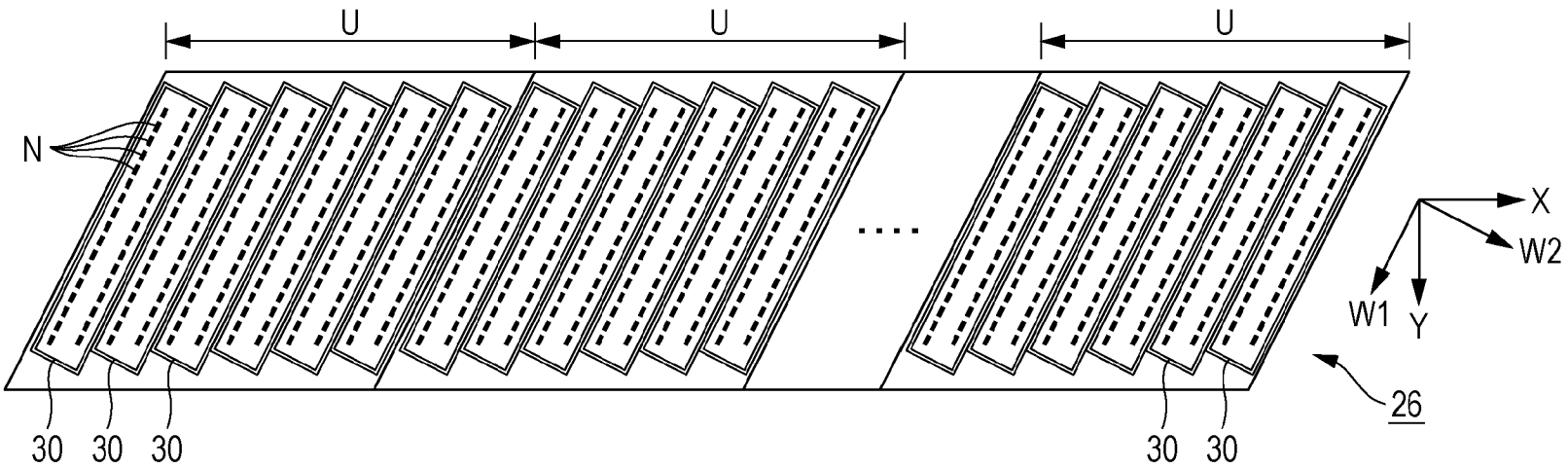
FIG. 2 is a planar diagram of a liquid ejecting module.
Figure 3:
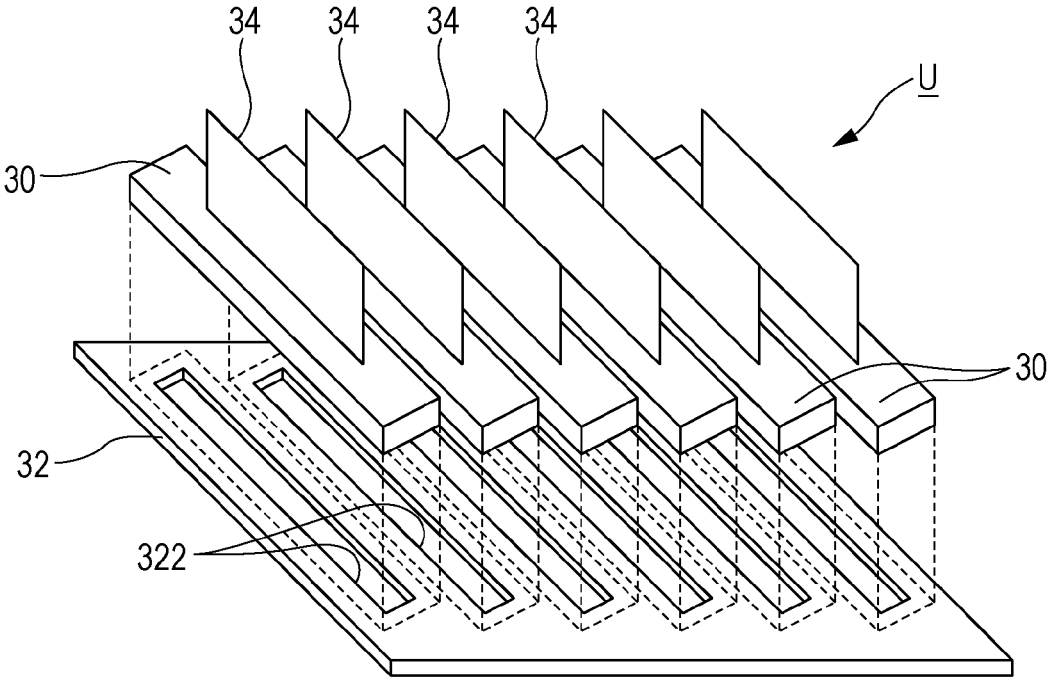
FIG. 3 is an exploded perspective diagram of a liquid ejecting unit.

FIG. 2 is a planar diagram of an opposite surface of the liquid ejecting module 26 to the medium 12. As exemplified in FIG. 2, the liquid ejecting module 26 includes a plurality of liquid ejecting units U which are arranged along the X direction. FIG. 3 is an exploded perspective diagram of each liquid ejecting unit U. As exemplified in FIGS. 2 and 3, each of the plurality of liquid ejecting units U contains a plurality of (6) liquid ejecting heads 30 which are arranged along the X direction. A plurality of nozzles (ejection openings) N are formed on each liquid ejecting head 30. As exemplified in FIG. 3, the six liquid ejecting heads 30 of the liquid ejecting module 26 are fixed to the surface of a fixing plate 32 with a flat plate form. Opening sections 322 which expose the nozzles N of each liquid ejecting head 30 are formed in the fixing plate 32. Ink of four colors that is retained in the liquid container 14 is supplied in parallel to the plurality of liquid ejecting heads 30 of each liquid ejecting module 26 and ejected from the nozzles N of each liquid ejecting head 30.

Figure 4:
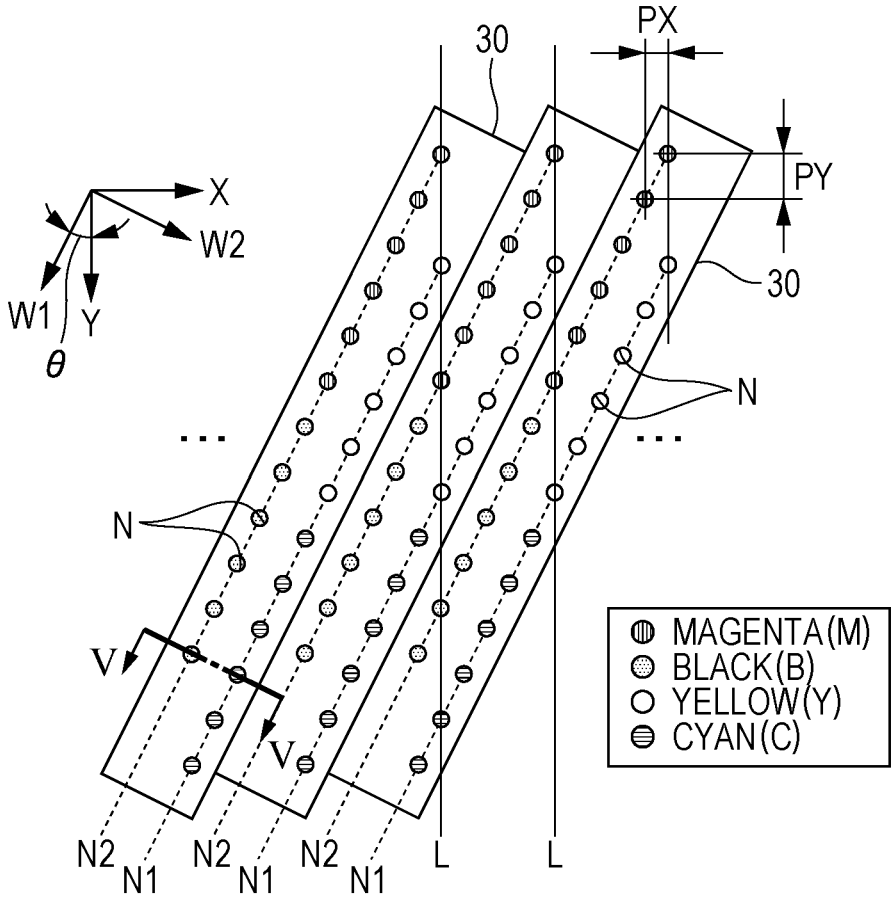
FIG. 4 is explanatory diagram of an array of a plurality of nozzles.

FIG. 4 is planar diagram focusing on an array of the plurality of nozzles N of the liquid ejecting head 30. As exemplified in FIG. 4, the plurality of nozzles N of each liquid ejecting head 30 are classified into a first nozzle row N1 and a second nozzle row N2. The first nozzle row N1 and the second nozzle row N2 respectively make up an aggregate of the plurality of nozzles N which are arranged along a W1 direction (the first direction) within the X-Y horizontal plane. The total number of nozzles N making up the first nozzle row N1 and the second nozzle row N2 are equal. The W1 direction is a direction which intersects with the X direction and the Y direction at a non-right-angle within the X-Y horizontal plane. In detail, the W1 direction is inclined at an angle θ with respect to the Y direction. The angle θ is set to 30° to 60° inclusive (preferably, within the range of 30° to 40° inclusive, or 50° to 60° inclusive). As above, in the first embodiment, since the plurality of nozzles N are arranged in the W1 direction which is inclined with respect to the Y direction along which the medium 12 is transported, in comparison to a configuration where the plurality of nozzles N are arranged along the X direction, it is possible to increase the practical dot density (resolution) of the medium 12 in the X direction.

The first nozzle row N1 and the second nozzle row N2 are arranged side by side with an interval from one another along a W2 direction (the second direction) that intersects with (typically orthogonal to) the W1 direction within the X-Y horizontal plane. As understood from FIG. 4, the first nozzle row N1 and the second nozzle row N2 of each liquid ejecting head 30 is arranged at an equal interval across each of the plurality of liquid ejecting heads 30. When focusing on the first nozzle row N1 and the second nozzle row N2 which are adjacent to one another in the W2 direction, the range in the X direction along which the plurality of nozzles N of the first nozzle row N1 are distributed and the range in the X direction along which the plurality of nozzles N of the second nozzle row N2 are distributed overlap one another.

Each nozzle N of the first nozzle row N1 and each nozzle N of the second nozzle row N2 have a common position in the X direction. That is, each nozzle N of the first nozzle row N1 and each nozzle N of the second nozzle row N2 are positioned on parallel straight lines in the Y direction. For example, a virtual line L links between the centers of one nozzle N which is positioned at an end section at the negative side in the W1 direction out of the first nozzle row N1 and one nozzle N which is positioned at an end section at the negative side in the W1 direction out of the second nozzle row N2 extends in a direction parallel to the Y direction and is inclined at the angle θ ($30° \leq \theta \leq 60°$) with respect to the W1 direction. Accordingly, it is possible to cause ink which is ejected from the nozzles N of the first nozzle row N1 and ink which is ejected from the nozzles N of the second nozzle row N2 to overlap at the same position on the medium 12 which is transported in the Y direction.

In addition, the respective plurality of nozzles N of the first nozzle row N1 and the second nozzle row N2 are formed such that a pitch (a distance between the centers of each of the nozzles N which are adjacent to one another) PX of each nozzle N in the X direction and a pitch PY of each nozzle N in the Y direction have an integer ratio (for example, PX:PY=1:2). According to the configuration above, it is advantageous in that in a case where an image in which a plurality of pixels are arranged in a matrix form is printed on the medium 12, a correspondence relationship between each pixel of the image which is specified by image data and each nozzle N of the liquid ejecting head 30 is simplified.

Each of the first nozzle row N1 and the second nozzle row N2 are utilized in ejection of ink of two different colors (four colors in total of the two colors of the first nozzle row N1 and the second nozzle row N2). In detail, as exemplified in FIG. 4, yellow (Y) ink is ejected from a prescribed number of nozzles N which are positioned at the negative side in the W1 direction out of the first nozzle row N1 of each liquid ejecting head 30 and cyan (C) ink is ejected from a prescribed number of nozzles N which are positioned at the positive side in the W1 direction out of the first nozzle row N1. In addition, magenta (M) ink is ejected from a prescribed number of nozzles N which are positioned at the negative side in the W1 direction out of the second nozzle row N2 of each liquid ejecting head 30 and black (B) ink is ejected from a prescribed number of nozzles N which are positioned at the positive side in the W1 direction out of the second nozzle row N2. In the configuration above, each of the nozzles N which correspond to the four different colors are arranged along the Y direction. Accordingly, it is possible to cause ink of the four colors to overlap at the same position on the medium 12 which is transported in the Y direction.

Figure 5:
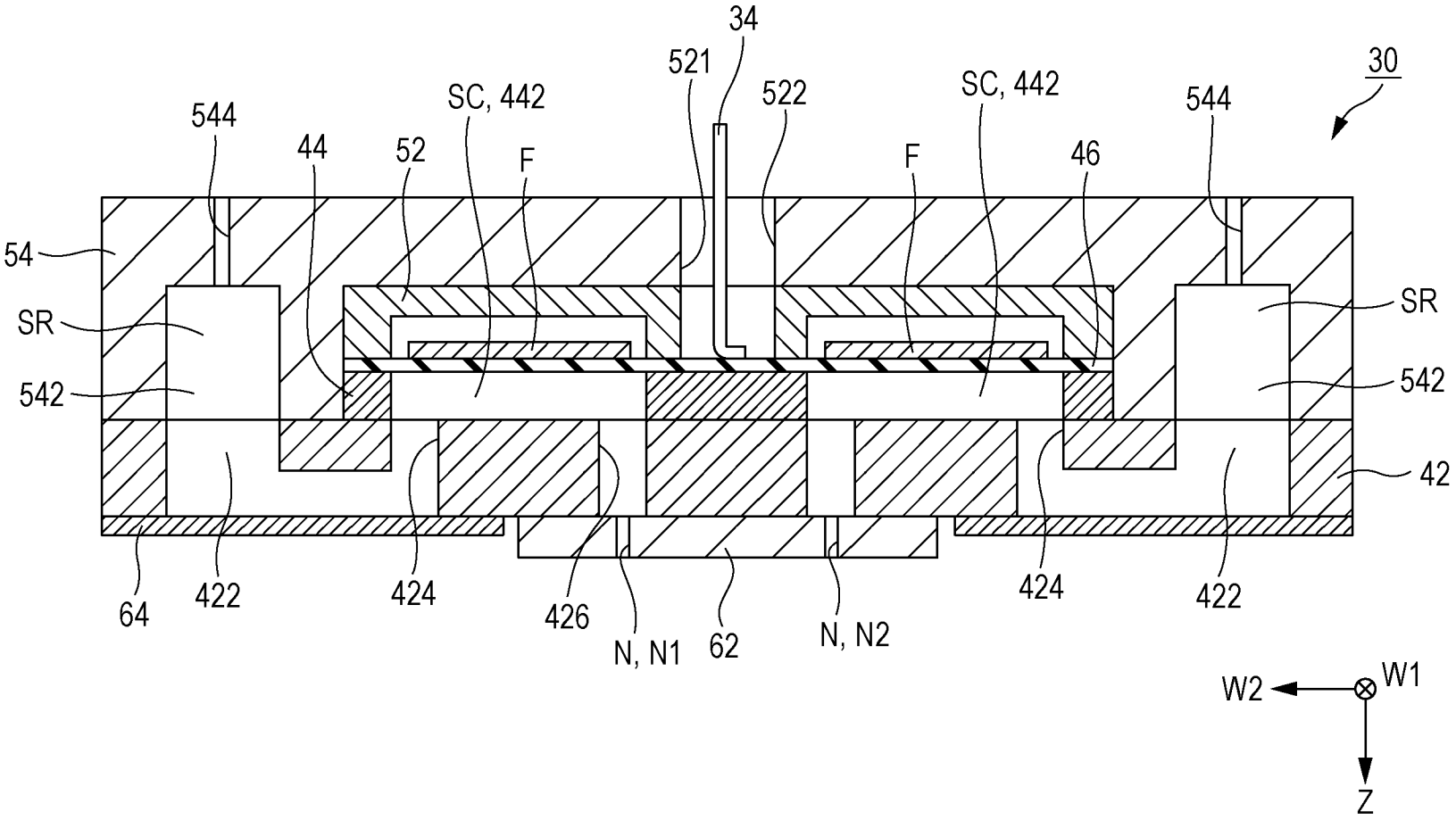
FIG. 5 is sectional diagram of a liquid ejecting head.

FIG. 5 is sectional diagram of one arbitrary liquid ejecting head 30 and is illustrated by the section of a line V-V in FIG. 4 (section perpendicular to the W1 direction). As exemplified in FIG. 5, the liquid ejecting head 30 has a structure (head chip) where a pressure chamber substrate 44, a vibration plate 46, a sealing body 52, and a support body 54 are installed on an upper surface at the negative side in the Z direction on a flow path substrate 42, and a nozzle plate 62 and a compliance section 64 are installed on an upper surface at the positive side in the Z direction on the flow path substrate 42. Each of the components of the liquid ejecting head 30 is a member with a substantially flat plate shape with a long dimension in the W1 direction in outline, and are fixed to one another utilizing, for example, an adhesive.

The plurality of nozzles N described above with reference to the FIG. 4 are formed on the nozzle plate 62. As understood from FIG. 5, a structure which corresponds to each nozzle N of the first nozzle row N1 and a structure which corresponds to each nozzle N of the second nozzle row N2 is formed in substantial line symmetry in each liquid ejecting head 30, therefore the structure of the liquid ejecting head 30 will be described below focusing on the first nozzle row N1 for convenience.

The flow path substrate 42 is a flat plate member which forms a flow path, and is formed by an opening section 422, a supply flow path 424, and a linking flow path 426. The supply flow path 424 and the linking flow path 426 are formed in each nozzle N, and the opening section 422 links across the plurality of nozzles N which eject one color of ink. The pressure chamber substrate 44 is a flat plate member which is formed by a plurality of the opening sections 422 which correspond to different nozzles N. The flow path substrate 42 and the pressure chamber substrate 44 are formed, for example, from a silicon single crystal substrate.

The compliance section 64 of FIG. 5 is a component for suppressing (absorbing) pressure variation within the flow path inside the liquid ejecting head 30, and is configured to include, for example, a flexible member formed in a sheet form. In detail, the compliance section 64 is fixed on the surface of the flow path substrate 42 such that the opening section 422 of the flow path substrate 42 and each supply flow path 424 are blocked.

As exemplified in FIG. 5, the support body 54 is fixed to the surface at the negative side in the Z direction on the flow path substrate 42. An accommodating section 542 and an introduction flow path 544 are formed in the support body 54. The accommodating section 542 is a concave section (cavity) with an outer form which corresponds to the opening section 422 of the flow path substrate 42 in planar view (that is, viewed from the Z direction), and the introduction flow path 544 is a flow path which links to the accommodating section 542. As understood from FIG. 5, the space, which links the opening section 422 of the flow path substrate 42 and the accommodating section 542 of the support body 54 with one another, functions as a liquid retaining chamber (reservoir) SR. The liquid retaining chamber SR is formed with each color of ink which is supplied from the liquid container 14 independent from one another, and retains ink which passes through the introduction flow path 544. That is, the four liquid retaining chambers SR which correspond to different ink are formed inside one arbitrary liquid ejecting head 30. The compliance section 64 in FIG. 5 configures the bottom surface of the liquid retaining chamber SR and absorbs pressure variation in ink inside the liquid retaining chamber SR.

The pressure chamber substrate 44 is a flat plate member which is formed by the plurality of opening sections 442 which correspond to different nozzles N. The vibration plate 46 is installed on the surface on the opposite side to the flow path substrate 42 on the pressure chamber substrate 44. The vibration plate 46 is a member with a flat plate form which is able to vibrate elastically. The vibration plate 46 is configured by, for example, a layer of an elastic film which is formed from an elastic material such as silicon oxide and an insulation film which is formed from an insulation material such as zirconium oxide. As understood from FIG. 5, the vibration plate 46 and the flow path substrate 42 are opposed so as to open a gap between one another at the inner side of each opening section 442 of the pressure chamber substrate 44. The space which is interposed between the flow path substrate 42 and the vibration plate 46 at the inner side of each opening section 442 functions as a pressure chamber (cavity) SC in which pressure is imparted to ink. Each pressure chamber SC is linked to the nozzle N via each linking flow path 426 of the flow path substrate 42.

Figure 6:
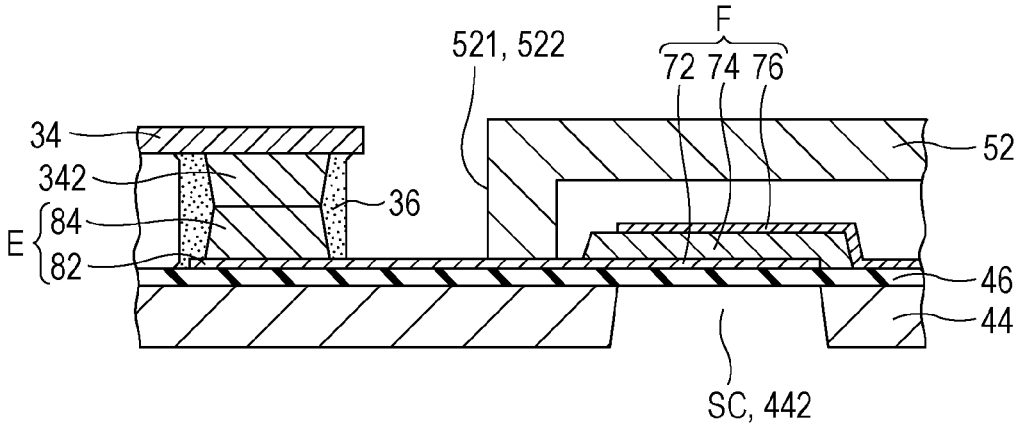
FIG. 6 is sectional diagram of the liquid ejecting head which is enlarged in the vicinity of a piezoelectric element.

A plurality of driving elements F which correspond to different nozzles N (pressure chambers SC) are formed on the surface which is opposite to the pressure chamber substrate 44 on the vibration plate 46. FIG. 6 is a sectional diagram (section perpendicular to the W1 direction) which is enlarged in the vicinity of one arbitrary driving element F. As exemplified in FIG. 6, each of the plurality of driving elements F are piezoelectric elements containing a first driving electrode 72 which is formed on an upper surface of the vibration plate 46, a piezoelectric body 74 which is formed on an upper surface on the first driving electrode 72, and a second driving electrode 76 which is formed on an upper surface of the piezoelectric body 74. An opposing region in which the first driving electrode 72 and the second driving electrode 76 interpose the piezoelectric body 74 functions as the driving element F.

The piezoelectric body 74 is formed, for example, in a process including heat treatment (firing). In detail, the piezoelectric body 74 is formed by a piezoelectric material which is coated on the surface of the vibration plate 46 on which a plurality of first driving electrodes 72 are formed being fired by means of heat treatment inside a firing furnace then molded (for example, milled utilizing plasma) in each driving element F. Each of the first driving electrodes 72 are individually formed in each driving element F and electrically insulated from one another, and each of the second driving electrodes 76 are individually formed in each driving element F and commonly connected to a wiring of a constant potential (for example, a reference potential such as a ground potential). Here, it is also possible to adopt a configuration in which the second driving electrode 76 is linked across the plurality of driving elements F.

Figure 7:
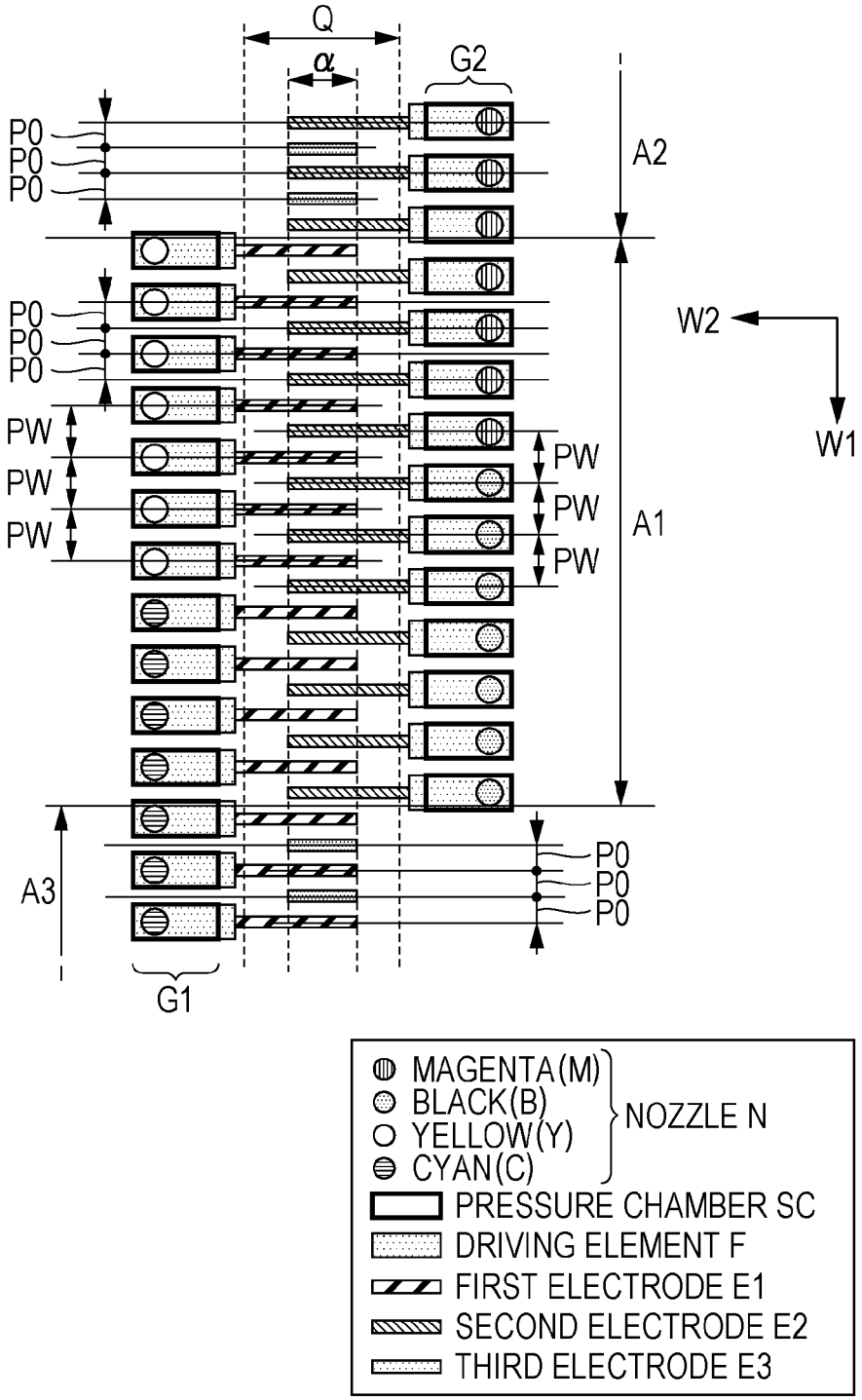
FIG. 7 is an explanatory diagram of the liquid ejecting head which is focused on a mounting region.

FIG. 7 is a schematic diagram of each component viewed from the negative side (opposite side to the medium 12) of the liquid ejecting head 30 in the Z direction. As exemplified in FIG. 7, the plurality of driving elements F of the liquid ejecting head 30 are classified into a first element group G1 and a second element group G2. The first element group G1 is an aggregate of the plurality of driving elements F (first driving elements) which correspond to each nozzle N of the first nozzle row N1 and the second element group G2 is an aggregate of the plurality of driving elements F (second driving elements) which correspond to each nozzle N of the second nozzle row N2. The plurality of driving elements F of the first element group G1 are arranged along the W1 direction, and in the same manner the plurality of driving elements F of the second element group G2 are also arranged along the W1 direction. A prescribed number of the driving elements F which are positioned at the negative side in the W1 direction within the first element group G1 correspond to yellow (that is, yellow ink is ejected from the nozzles N by imparting pressure to the pressure chamber SC in which yellow ink is filled), and a prescribed number of the driving elements F which are positioned at the positive side in the W1 direction within the first element group G1 correspond to cyan. Meanwhile, a prescribed number of the driving elements F which are positioned at the negative side in the W1 direction within the second element group G2 correspond to magenta and a prescribed number of the driving elements F which are positioned at the positive side in the W1 direction within the second element group G2 correspond to black.

The first element group G1 and the second element group G2 are arranged side by side with an interval from one another along the W2 direction. As exemplified in FIG. 7, a region in which mounting components are installed (hereinafter referred to as a "mounting region") Q is secured between the first element group G1 and the second element group G2 on the surface of the vibration plate 46. That is, the plurality of the driving elements F of the first element group G1 and the plurality of the driving elements F of the second element group G2 interpose the mounting region Q with a long dimension in the W1 direction and are positioned at opposite sides to one another. In the first embodiment, as exemplified in FIG. 5 and FIG. 6, a flexible wiring board 34 (COF: chip on film) for electrically connecting the liquid ejecting head 30 to an external apparatus (the control device 22 and a power supply circuit) is mounted in the mounting region Q as the mounting component.

The sealing body 52 in FIG. 5 is a structure that protects each driving element F (for example, prevents adhesion of water or the like to the driving elements F) and reinforces the mechanical strength of the pressure chamber substrate 44 and the vibration plate 46, and is fixed to the surface of the vibration plate 46 using, for example, an adhesive. Each driving element F is accommodated in a concave section which is formed on the surface at the vibration plate 46 side within the sealing body 52. As exemplified in FIG. 5, the sealing body 52 of the first embodiment includes a first wall surface 521 which is positioned between the mounting region Q and the first element group G1 in planar view and a second wall surface 522 which is positioned between the mounting region Q and the second element group G2 in planar view. That is, the mounting region Q can be said to be a region which is interposed by the first wall surface 521 and the second wall surface 522 in planar view.

As exemplified in FIG. 7, a plurality of electrodes E are formed in the mounting region Q on the surface of the vibration plate 46. Each electrode E is a conductive body which is formed (patterned) in a shape that extends in the W2 direction in planar view, and is utilized electrically connected to each wiring on the wiring board 34 and each driving element F on the surface of the vibration plate 46. The plurality of electrodes E within the mounting region Q includes the plurality of first electrodes E1, the plurality of second electrodes E2, and the plurality of third electrodes E3. Here, in a configuration in which the vibration plate 46 is removed in the mounting region Q, it is possible to form the plurality of electrodes E on the surface of the pressure chamber substrate 44.

As exemplified in FIG. 7, the mounting region Q is classified into a first region A1, a second region A2, and a third region A3. The second region A2 is positioned at the negative side in the W1 direction viewed from the first region A1 and the third region A3 is positioned at the positive side in the W1 direction viewed from the first region A1. That is, the first region A1 is positioned between the second region A2 and the third region A3. As understood from FIG. 7, the first region A1 is equivalent to a region in which the first element group G1 and the second element group G2 (the first nozzle row N1 and the second nozzle row N2) overlap with one another along the W1 direction. Meanwhile, the second region A2 is equivalent to a region that the first element group G1 does not overlap within the range in the W1 direction in which the second element group G2 is present, and the third region A3 is equivalent to a region that the second element group G2 does not overlap within the range in the W1 direction in which the first element group G1 is present.

The plurality of first electrodes E1 are arranged at a prescribed pitch PW along the W1 direction across the first region A1 and the third region A3 within the mounting region Q. Meanwhile, the plurality of second electrodes E2 are arranged along the W1 direction at the same pitch PW as each first electrode E1 across the first region A1 and the second region A2 within the mounting region Q. Each of the plurality of first electrodes E1 are electrically connected to each driving element F (the first driving elements) of the first element group G1 extending to the positive side of the W2 direction within the mounting region Q, and each of the plurality of second electrodes E2 are electrically connected to each driving element F (the second driving elements) of the second element group G2 extending to the negative side in the W2 direction within the mounting region Q. In detail, as exemplified in FIG. 6, each first electrode E1 and each second electrode E2 is configured by layers of a connection wiring 82 and a connection terminal 84. The connection wiring 82 is a conductive body (wiring) which is connected to the first driving element 72 of each driving element F. In the first embodiment, a configuration is exemplified in which the connection wiring 82 is linked to the same layer as the first driving electrode 72, but it is possible to connect the connection wiring 82, which is formed on a separate layer to the first driving electrode 72, to the first electrode E1. Meanwhile, the connection terminal 84 is a conductive body (crimped terminal) which is formed on the surface of an end section at the opposite side to the driving elements F on the connection wiring 82.

As exemplified in FIG. 7, the plurality of first electrodes E1 and the plurality of second electrodes E2 are alternately arranged along the W1 direction at a half pitch P0 of the pitch PW (P0=PW/2) within the first region A1 in the mounting region Q. That is, the second electrode E2 is positioned between two first electrodes E1 which are adjacent to one another in the W1 direction. The range in which the first electrodes E1 are present along the W2 direction and the range in which the second electrodes E2 are present along the W2 direction overlap with one another in the W2 direction. That is, both the first electrodes E1 and the second electrodes E2 are present within a prescribed range $\alpha$ in the W2 direction within the mounting region Q.

As exemplified in FIG. 7, the plurality of third electrodes E3 are formed in each of the second region A2 and the third region A3. Meanwhile, the third electrodes E3 are not formed in the first region A1. In addition, the third electrodes E3 of the first embodiment are not electrically connected to any of the driving elements F with respect to the first electrodes E1 and the second electrodes E2 which are electrically connected to each driving element F as above. That is, the third electrodes E3 are dummy electrodes (ineffective wirings) that do not actually contribute to operation (ink ejection) of the driving elements F.

Each of the plurality of third electrodes E3 is formed on the same layer as the first electrodes E1 and the second electrodes E2 (the layer of the connection wiring 82 and the connection terminal 84). Each third electrode E3 which is formed within the second region A2 in the mounting region Q is positioned between two second electrodes E2 which are adjacent to one another at the pitch PW along the W1 direction within the second region A2. In detail, as exemplified in FIG. 7, the second electrodes E2 and the third electrodes E3 are alternately arranged along the W1 direction within the second region A2 at a pitch P0 which is the same as the pitch P0 at which the first electrodes E1 and the second electrodes E2 are arranged within the first region A1 of the mounting region Q. Meanwhile, each third electrode E3 which is formed within the third region A3 in the mounting region Q is positioned between two first electrodes E1 which are adjacent to one another at the pitch PW along the W1 direction within the third region A3. In detail, as exemplified in FIG. 7, the first electrodes E1 and the third electrodes E3 are alternately arranged along the W1 direction within the third region A3 at the same pitch P0 at which the first electrodes E1 and the second electrodes E2 are arranged within the first region A1. As understood from the above explanation, in the first embodiment, the plurality of electrodes E, across the entire mounting region Q which includes the second region A2 and the third region A3 in addition to the first region A1, are arranged at the equal pitch P0 along the W1 direction.

The range in which the third electrodes E3 are present along the W2 direction within the mounting region Q overlaps with the range of the first electrodes E1 and the second electrodes E2 in the W2 direction. That is, each third electrode E3 is present in the second region A2 and the third region A3 within the range $\alpha$ in which the first electrodes E1 and the second electrodes E2 overlap and are present within the mounting region Q.

As above, the flexible wiring board 34 is mounted in the mounting region Q. As exemplified in FIG. 6, the wiring board 34 is fixed to the surface of the vibration plate 46 using adhesive 36 in a state where the connection terminal 342 (wiring) which is formed on the surface of the wiring board 34 is in contact with each electrode E (connection terminal 84) on the surface of the vibration plate 46. In detail, the adhesive 36 with a liquid form is coated within the mounting region Q (range $\alpha$), and the wiring board 34 is mounted on the liquid ejecting head 30 by curing the adhesive 36 in a state where an end section of the wiring board 34 is pressed on the surface of the vibration plate 46. Driving signals for controlling each of the driving elements F are supplied from each of the connection terminals 342 of the wiring board 34 to each of the driving elements F of the first element group G1 via the first electrodes E1 and supplied to each of the driving elements F of the second element group G2 via the second electrodes E2.

A configuration in which the third electrodes E3 are not formed in the second region A2 or the third region A3 is assumed as a comparative example of the first embodiment. In the comparative example, the first electrodes E1 and the second electrodes E2 are alternatively arranged within the first region A1 at the pitch P0 along the W1 direction, but only the second electrodes E2 are arranged within the second region A2 at the pitch PW and only the first electrodes E1 are arranged within the third region A3 at the pitch PW. That is, the densities of the electrodes E in the second region A2 and the third region A3 are different from the first region A1. In detail, the densities of each of the electrodes E of the second electrodes E2 and the third electrodes E3 are lower than the densities in the first region A1. In the comparative example above, it is possible to distribute the adhesive 36 which is coated on the surface of the vibration plate 46 for mounting on the wiring board 34 in a narrow space between the first electrodes E1 and the second electrodes E2 which are adjacent to one another at the pitch P0 in the first region A1 and in a wide space between each of the second electrodes E2 which are adjacent to one another at the pitch PW (PW=P0×2) in the second region A2. Accordingly, in a case where the coating amount of the adhesive 36 is selected so as to optimally distribute the adhesive 36 within the first region A1, the adhesive 36 is insufficient within the second region A2 and as a result it becomes difficult to sufficiently secure the adhesive strength of the wiring board 34. Meanwhile, excess of the adhesive 36 within the first region A1 becomes a problem in a case where the coating amount of the adhesive 36 is selected so as to optimally distribute the adhesive 36 within the second region A2. For example, in a case in which there is an excess of the adhesive 36 within the first region A1, the adhesive 36 in the first region A1 flows within a wide range and reaches the sealing body 52 in a process in which the wiring board 34 is pressed with respect to the vibration plate 46, and there is a problem of positional deviation of the wiring board 34 due to stress from the adhesive 36 which is blocked by the first wall surface 521 and the second wall surface 522. Here, the first region A1 and the second region A2 are focused on for convenience in the explanation above, but it is possible for the problem to occur in the same manner in the third region A3.

In contrast to the comparative example exemplified above, in the first embodiment, while the first electrodes E1 and the second electrodes E2 are arranged alternatively at the pitch P0 within the first region A1, the third electrodes E3 are formed between the two second electrodes E2 adjacent to one another within the second region A2, and the third electrodes E3 are formed between the two first electrodes E1 adjacent to one another within the third region A3. That is, in the first embodiment, a difference (a difference between the first region A1 and the second region A2 or the third region A3) in densities of the electrodes E within the mounting region Q are suppressed in comparison to the comparative example, Accordingly, according to the first embodiment, it is advantageous in that it is possible to eliminate the problem above (insufficient adhesive strength or positional error of the wiring board 34) in the comparative example caused by a difference in densities of the electrodes E within the mounting region Q. In the first embodiment, in particular, since the second electrodes E2 and the third electrodes E3 are arranged within the second region A2 at the same pitch P0 as an array of the first electrodes E1 and the second electrodes E2 within the first region A1, the result described above where the difference in densities of the electrodes E between the first region A1 and the second region A2 is suppressed is particularly remarkable. Here, the problem described above where a positional error occurs due to the excess adhesive 36 being pressed on the wiring board 34 occurs as a result of the excess portion of the adhesive 36 reaching the sealing body 52 and blocking the wiring board 34 using the first wall surface 521 and the second wall surface 522. When considering the above circumstances, in the first embodiment, a configuration is particularly preferable in which the sealing body 52 is installed with a shape where the first wall surface 521 is positioned between the mounting region Q and the first element group G1 and the second wall surface 522 is positioned between the mounting region Q and the second element group G2.

Here, in the explanation above, the problem which is related to adhesion of the wiring board 34 is exemplified, but the problem which is caused by the densities of the electrodes E within the mounting region Q is not limited to the exemplification above. For example, in the comparative example in which the third electrodes E3 are not formed, since the degree of heat conduction is different between the first region A1 in which the density (pitch P0) of the plurality of electrodes E is high and the second region A2 in which the density (pitch PW) of the plurality of electrodes E is low, for example, in a process in which the piezoelectric body 74 is fired using heat treatment, it is possible for a difference in temperature (heat distribution bias) between the first region A1 and the second region A2 or the third region A3 to be generated. In a state in which heat distribution is biased as above, it is possible for the problem such as film formation failure to occur in a component which is formed in each of the following processes. Meanwhile, in the first embodiment in which the third electrodes E3 are formed in the second region A2 and the third region A3, heat distribution within the mounting region Q is uniformized since the densities of the electrodes E within the mounting region Q are suppressed. Accordingly, it is advantageous in that it is possible to prevent the problem such as film formation failure which is caused by heat distribution bias. As understood from the above explanation, the result of the first embodiment described above in which the densities of the plurality of electrodes E within the mounting region Q are uniformized by forming the third electrodes E3 is able to be sufficiently exhibited even in a configuration in which adhesion of the wiring board 34 is not assumed. That is, a configuration in which the wiring board 34 is adhered utilizing the adhesive 36 is not essential in the invention.

Second Embodiment

The second embodiment of the invention will be described below. Here, in each of the aspects exemplified below, concerning components which have the same actions and functions as the first embodiment, detailed explanation will be omitted as appropriate by using the same reference numerals which are explained in the first embodiment.

Figure 8:
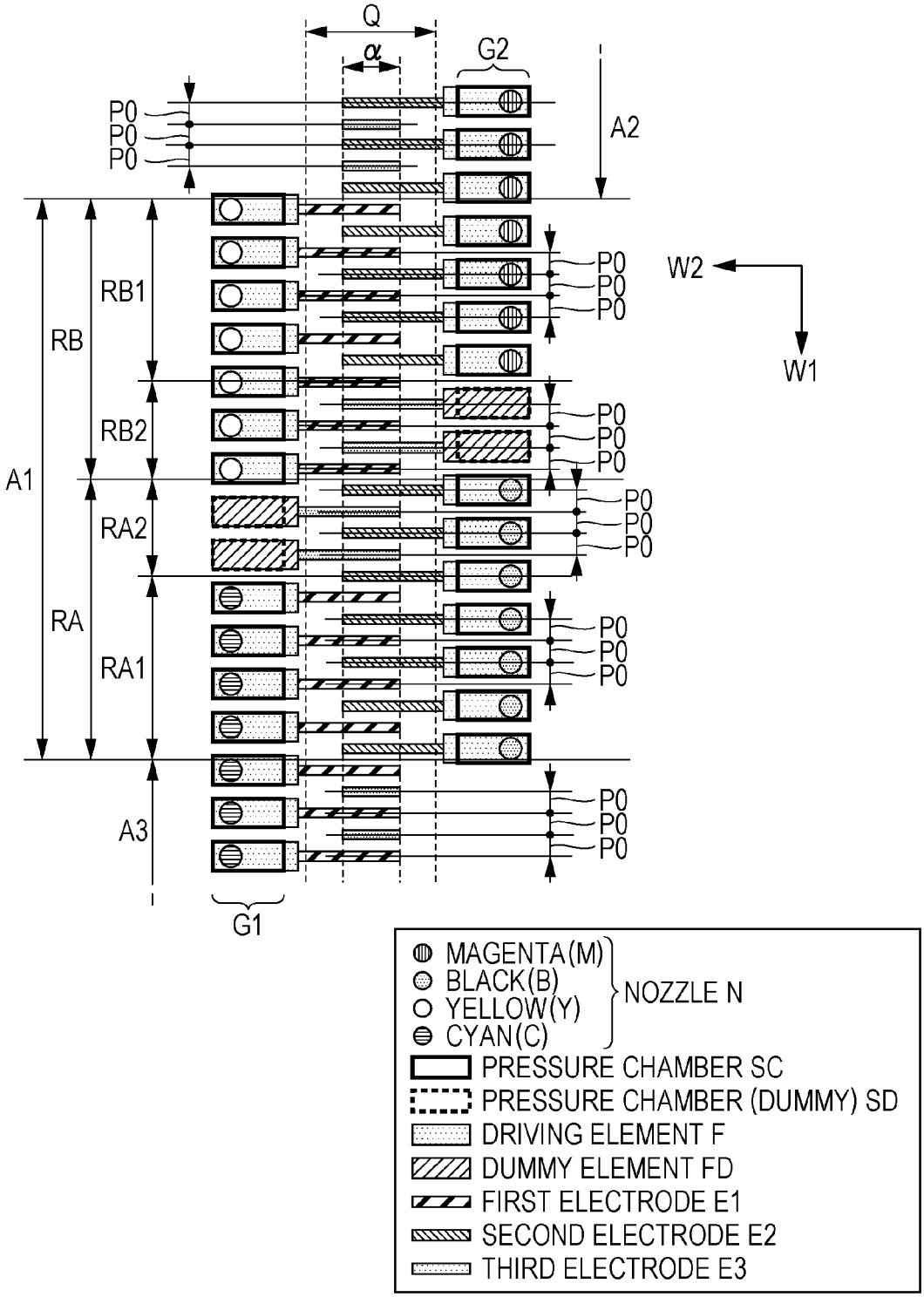
FIG. 8 is an explanatory diagram of a liquid ejecting head according to a second embodiment.

FIG. 8 is a schematic diagram of each component viewed from the negative side in the Z direction of the liquid ejecting head 30 according to a second embodiment. As exemplified in FIG. 8, the liquid ejecting head 30 of the second embodiment includes a plurality of dummy elements FD which are not actually utilized in ejection of ink. In detail, as exemplified in FIG. 8, the plurality of dummy elements FD are formed between the plurality of driving elements F which correspond to yellow and the plurality of driving elements F which correspond to cyan out of the first nozzle row G1 (that is, between colors of the first nozzle row N1) and the plurality of dummy elements FD are formed between the plurality of driving elements F which correspond to magenta and the plurality of driving elements F which correspond to black out of the second nozzle row G2. Each dummy element FD is configured by layers of the first driving electrode 72, the piezoelectric body 74, and the second driving electrode 76 in the same manner as the driving elements F which are actually utilized in ejection of ink.

A pressure chamber SD which corresponds to each dummy element FD is formed on the pressure chamber substrate 44 of the second embodiment. The pressure chamber SD is formed with a structure in the same manner (common or similar) as the pressure chamber SC which corresponds to the driving elements F and is a pseudo-space which is not actually utilized in ejection of ink. In detail, ink is supplied from the liquid retaining chamber SR to each pressure chamber SD, but the linking flow path 426 and the nozzles N are not formed on the downstream side of the pressure chamber SD. Accordingly, ink is not ejected even if pressure inside the pressure chamber SD varies. As understood from the above explanation, even though each dummy element FD is formed with the structure in the same manner (common or similar) as the driving elements F which are actually utilized in ejection of ink, but is actually a pseudo-element that does not contribute to ejection of ink.

In the second embodiment, the first region A1 of the mounting region Q is classified into a region RA and a region RB. The region RA is positioned at the positive side in the W1 direction viewed from the region RB. The region RA includes a region RA1 at the third region A3 side and a region RA2 which is positioned at the negative side in the W1 direction viewed from the region RA1, and the region RB includes a region RB1 at the second region A2 side and a region RB2 which is positioned at the positive side in the W1 direction viewed from the region RB1. The region RA2 is positioned between the plurality of dummy elements FD of the first element group G1 and the black driving elements F of the second element group G2, and the region RB2 is positioned between the plurality of dummy elements FD of the second element group G2 and the yellow driving elements F of the first element group G1.

In the region RA1 of the mounting region Q, the plurality of first electrodes E1 which are connected to each driving element F of the first element group G1 are arranged at the pitch PW along the W1 direction. In addition, the plurality of second electrodes E2 which are connected to each driving element F of the second element group G2 are arranged at the pitch PW along the W1 direction across the region RA1 and the region RA2. Accordingly, in the region RA1, the plurality of first electrodes E1 and the plurality of second electrodes E2 are arranged alternatively at the pitch P0 along the W1 direction in the same manner as the first region A1 of the first embodiment. Meanwhile, since each dummy element FD is not actually utilized in ejection of ink, the electrodes E which correspond to each dummy element FD are inherently unnecessary. However, in the second embodiment, as exemplified in FIG. 8, the plurality of third electrodes E3 which are electrically connected to each dummy element FD are formed in the region RA2. In the region RA2, in the same manner as within the second region A2, the plurality of second electrodes E2 and the plurality of third electrodes E3 are alternatively arranged at the pitch P0 along the W1 direction such that the third electrodes E3 are positioned between each second electrode E2 which are adjacent to one another.

The plurality of electrodes E are arranged in the same manner within the region RB. That is, the first electrodes E1 and the second electrodes E2 are arranged alternatively at the pitch P0 along the W1 direction within the region RB1, and the first electrodes E1 which are connected to each driving element F of the first element group G1 and the third electrodes E3 which are connected to each dummy element FD are arranged alternatively at the pitch P0 along the W1 direction in the region RB2.

The array of each electrode E in the second region A2 and the third region A3 is the same as the first embodiment. Accordingly, similar effects to those in the first embodiment are also realized in the second embodiment. In addition, in the second embodiment, since the third electrodes E3 are formed in the region RA2 and the region RB2 in the same manner as the second region A2 and the third region A3, for example, in comparison to a configuration in which the third electrodes E3 are not formed in the region RA2 and the region RB2, a difference in densities of the electrodes E between the region RA1 and the region RA2 or between the region RB1 and the region RB2 is reduced. Accordingly, in the same manner as the first embodiment, it is advantageous in that it is possible to eliminate the problem described above (insufficient adhesive strength or positional error of the wiring board 34) caused by a difference in densities of the electrodes E within the mounting region Q. As understood from the above explanation, the "third electrodes" in the invention also include the third electrodes E3 which are formed in the region RA2 and the region RB2 which correspond to the dummy elements FD in addition to the third electrodes E3 which are formed in the second region A2 and the third region A3.

Here, in the second embodiment, a configuration is exemplified in which the third electrodes E3 which are formed in the region RA2 and the region RB2 are connected to the dummy elements FD. That is, the electrical configuration to the wiring board 34 is common between the driving elements F and the dummy elements FD. In FIG. 8, a configuration (hereinafter referred to as "configuration 1"), in which an ink flow path which corresponds to each dummy element FD is blocked, is exemplified, but as long as the ink flow path which corresponds to each dummy element FD is linked from the liquid retaining chamber SR to the nozzles N, a configuration (hereinafter referred to as "configuration 2") in which ink is ejected utilizing each dummy element FD as a normal driving element F is realized. Configuration 1 is preferable in a case where ink of a plurality of colors is ejected by the respective first element group G1 and the second element group G2, and configuration 2 is preferable in a case, for example, where ink of one color (for example, black) is ejected from all of the nozzles N. As understood from the above explanation, in the second embodiment, it is advantageous in that it is possible to commonly use an electrical structure from each of the driving elements F to the wiring board 34 in configuration 1 and configuration 2 (thus structural costs are reduced). However, it is also possible to adopt a configuration in which the third electrodes E3 within the region RA2 and the region RB2 which are not electrically connected to each dummy element FD (for example, a configuration in which the third electrodes E3 are formed so as to be included in the range $\alpha$ within the region RA2 or within the region RB2).

Third Embodiment

Figure 9:
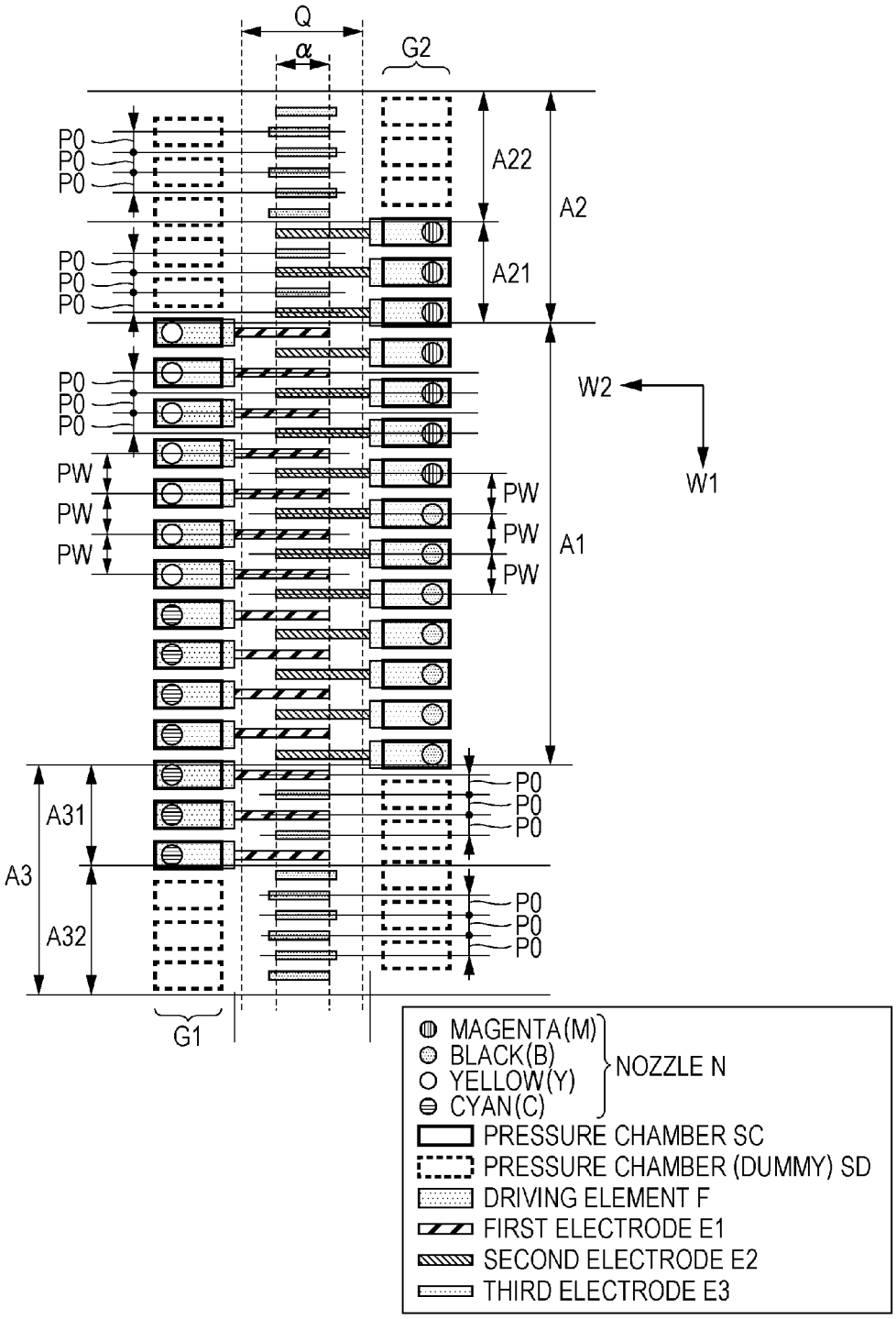
FIG. 9 is an explanatory diagram of a liquid ejecting head according to a third embodiment.

FIG. 9 is a schematic diagram of each component viewed from the negative side in the Z direction of the liquid ejecting head 30 according to a third embodiment. As exemplified in FIG. 9, in the third embodiment, a plurality of pressure chambers SD are formed at the positive side and the negative side in the W1 direction viewed from the pressure chambers SC which correspond to each of the driving elements F of the first element group G1. In the same manner, a plurality of the pressure chambers SD are formed at the positive side and the negative side in the W1 direction viewed from the pressure chambers SC which correspond to each of the driving elements F of the second element group G2. In the same manner to the second embodiment, each pressure chamber SD is formed with a structure in the same manner as the pressure chamber SC and is a pseudo-space which is not actually utilized in ejection of ink.

In the configuration where the pressure chambers SD are not formed at both sides of the array of the plurality of pressure chambers SC (for example, the first embodiment), it is possible that pressure variation conditions in the pressure chambers SC which are positioned at both end sections of the array and the pressure chambers SC which are positioned near the center of the array out of the plurality of pressure chambers SC (whether other pressure chambers SC are present only at one side in the W1 direction, or whether other pressure chambers SC are present at both sides in the W1 direction) are different. Accordingly, it is possible that ejection characteristics (the amount of ejection or the speed of ejection) of ink from each nozzle N in each of the first nozzle row N1 and the second nozzle row N2 are different according to the position of the nozzle N. In the third embodiment, since a dummy pressure chamber SD is formed in the configuration in the same manner as each pressure chamber SC on both sides of the array of the plurality of pressure chambers SC, it is possible for pressure variation conditions to be close between the pressure chambers SC which are positioned at both end sections of the array and the pressure chambers SC which are positioned near the center of the array out of the plurality of pressure chambers SC. Accordingly, it is advantageous in that the ejection characteristics of ink from each of the nozzles N is uniformized at both end sides and near to the center in each of the first nozzle row N1 and the second nozzle row N2.

In the third embodiment, the second region A2 of the mounting region Q is classified into a region A21 and a region A22. The region A21 is a region at the first region A1 side within the second region A2 and the region A22 is a region at the opposite side to the first region A1 within the second region A2. Each driving element F of the second element group G2 is present at the negative side in the W2 direction viewed from the region A21. In the same manner as the second region A2 of the first embodiment, the second electrodes E2 which are connected to the driving elements F are formed in the region A21, and the second electrodes E2 and the third electrodes E3 are arranged in the W1 direction at the pitch P0 such that the third electrodes E3 are positioned between each of the second electrodes E2 which are adjacent to one another. Accordingly, similar effects to those in the first embodiment are also realized in the third embodiment.

Meanwhile, since the driving elements F are not present at either of the positive side or the negative side in the W2 direction of the region A22 within the second region A2, neither the first electrodes E1 nor the second electrodes E2 are formed in the region A22. As exemplified in FIG. 9, in the third embodiment, the plurality of third electrodes E3 are formed in the region A22. The plurality of third electrodes E3 are arranged in the region A22 along the W1 direction at the same pitch P0 as the array of the first electrodes E1 and the second electrodes E2 in the first region A1 and the array of the second electrodes E2 and the third electrodes E3 in the region A21 of the second region A2.

The second region A2 is focused on in the explanation above, but a configuration is also adopted in the same manner in the third region A3. That is, the plurality of first electrodes E1 and the plurality of third electrodes E3 are arranged at the pitch P0 along the W1 direction in a region A31 at the first region A1 side within the third region A3 and the plurality of third electrodes E3 are arranged at the pitch P0 along the W1 direction in a region A32 at the opposite side to the first region A1 within the third region A3.

As explained above, in the third embodiment, the plurality of third electrodes E3 are arranged along the W1 direction at the pitch P0 in the region A22 at the opposite side to the first region A1 within the second region A2. Accordingly, it is advantageous in that the densities of the electrodes E across a wide range including the region A22 in which the second electrodes E2 are not present in addition to the region A21 in which the second electrodes E2 are present in the second region A2 are uniformized. In the same manner, concerning the third region A3, it is advantageous in that the densities of the electrodes E across a wide range including the region A32 in which the first electrodes E1 are not present in addition to the region A31 in which the first electrodes E1 are present are uniformized. Here, it is also possible to apply the configuration of the second embodiment to the third embodiment.

Fourth Embodiment

Figure 10:
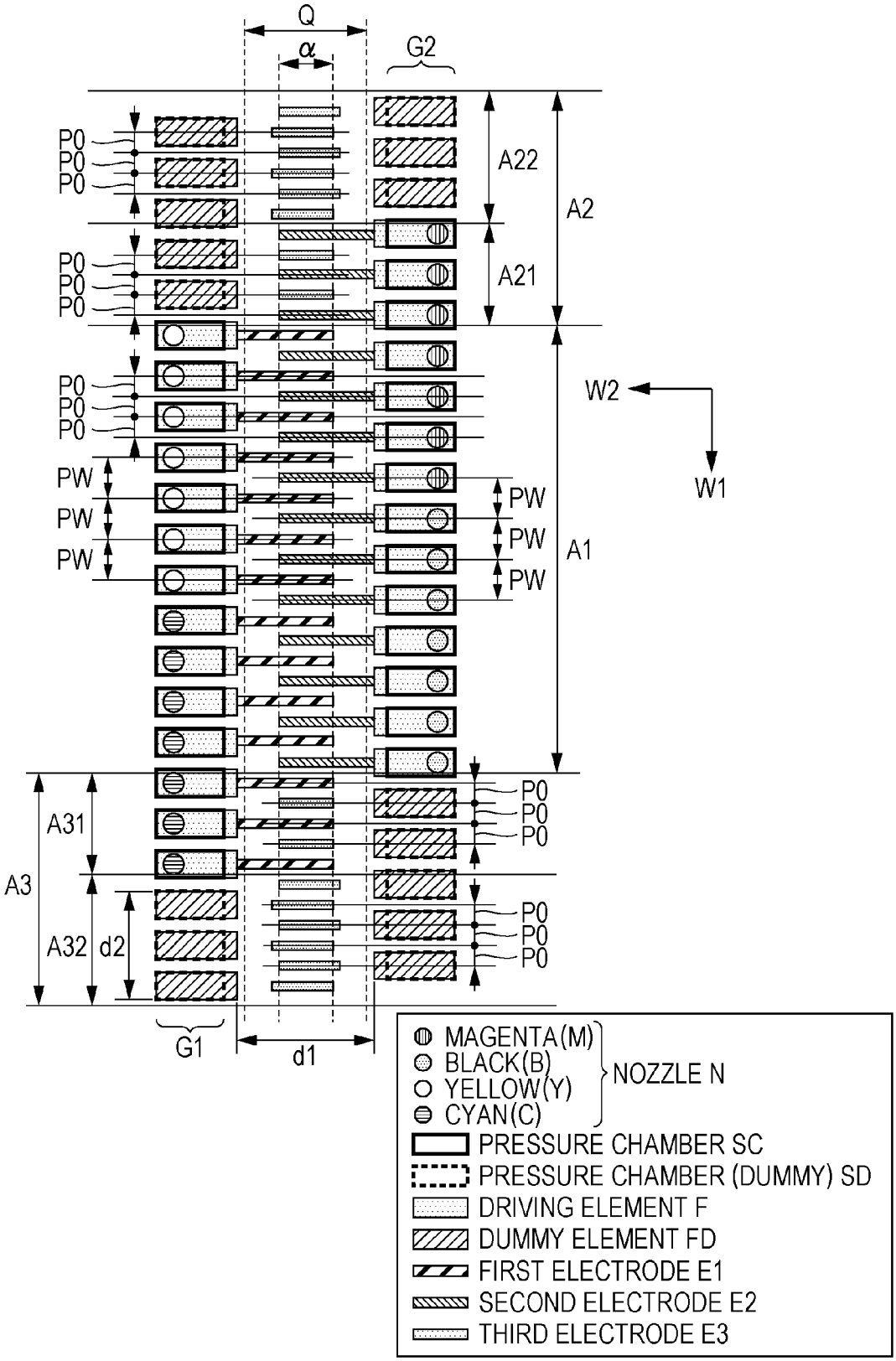
FIG. 10 is an explanatory diagram of a liquid ejecting head according to a fourth embodiment.

FIG. 10 is a schematic diagram of each component viewed from the negative side in the Z direction of the liquid ejecting head 30 according to a fourth embodiment. In the third embodiment, the dummy pressure chambers SD are formed on both sides of the array of the plurality of pressure chambers SC. In the fourth embodiment, in addition to the configuration of the third embodiment, dummy elements FD are formed which correspond to each of the pressure chambers SD. Each dummy element FD is formed in a structure in the same manner as the driving elements F, but is a pseudo-element that is not actually utilized in ejection of ink, as described above in the second embodiment, the first driving electrode 72, the piezoelectric body 74, and the second driving electrode 76 configure a layer in the same manner as each of the driving elements F. As understood from the above explanation, in the fourth embodiment, the dummy elements FD which include the first driving electrode 72 (fourth electrode), the piezoelectric body 74, and the second driving electrode 76 are formed at both sides in the W1 in each of the first element group G1 and the second element group G2 (the opposite side to the other end section which interposes one end section in an array of the plurality of driving elements F).

As understood from FIG. 10, an interval d1 between the first driving electrode 72 of each of the driving elements F of the first element group G1 and the first driving electrode 72 of each of the driving elements F of the second element group G2 is wide in comparison to a range d2 in which the first driving electrode 72 of the plurality of dummy elements FD is distributed at the positive side in the W1 direction in the first element group G1 or at the negative side in the W1 direction in the second element group G2 (d1>d2).

Similar effects to those in the third embodiment are also realized in the fourth embodiment. Here, as described above, the piezoelectric body 74 of each driving element F is formed by a piezoelectric material which is coated on the surface of the vibration plate 46 being fired by means of heat treatment inside a firing furnace then separated into each driving element F. Since the degree of heat conduction is different in a region in which the first driving electrode 72 is formed on the surface of the vibration plate 46 and a region in which the first driving electrode 72 is not formed, it is possible for a difference in temperature (bias of distribution on the X-Y horizontal plane) to occur according to presence or absence of the first driving electrode 72 in a heat treatment stage in a process in which the piezoelectric body 74 is formed. In the third embodiment, since the first driving electrode 72 of the dummy elements FD is formed in a region which corresponds to each pressure chamber SD in addition to the first driving electrode 72 of the driving elements F being formed in a region which corresponds to each pressure chamber SC, heat distribution is uniformized at the region of each pressure chamber SC and the region of each pressure chamber SD. Accordingly, it is advantageous in that it is possible to prevent the problem such as film formation failure of the piezoelectric material which is caused by heat distribution bias. Here, it is also possible to apply the configuration of the second embodiment to the fourth embodiment.

Modification Example

It is possible for the aspects which are exemplified above to be variously modified. Modified aspects will be exemplified in detail below. It is possible to appropriately combine two or more aspects which are arbitrarily selected from the above exemplifications within a range which is not mutually inconsistent.

(1) In each aspect described above, a configuration is exemplified in which a driving signal is supplied to the first driving electrode 72 which is positioned at the vibration plate 46 side out of the driving elements F (the dummy elements FD) and the second driving electrode 76 at the opposite side to the vibration plate 46 is set to a common constant potential, but it is also possible to adopt a configuration in which each first driving electrode 72 is set with a common constant potential and the driving signal of each driving element F is supplied to each second driving electrode 76. In addition, in the aspect described above, the structure of the dummy elements FD are exemplified in the same manner as the driving elements F, but the structure of the dummy elements FD is not limited to the exemplification above. For example, it is possible to form the structure of the dummy elements FD in which a portion of the first driving element 72, the piezoelectric body 74, and the second driving electrode 76 is omitted.

(2) In each aspect described above, a configuration is exemplified in which the first nozzle row N1 and the second nozzle row N2 are formed on one liquid ejecting head 30, but the number of the nozzle row on which one liquid ejecting head 30 is formed is appropriately modified. For example, it is also possible to adopt a configuration in which the plurality of nozzles N of one liquid ejecting head 30 are arranged on a third row or above.

Figure 11:
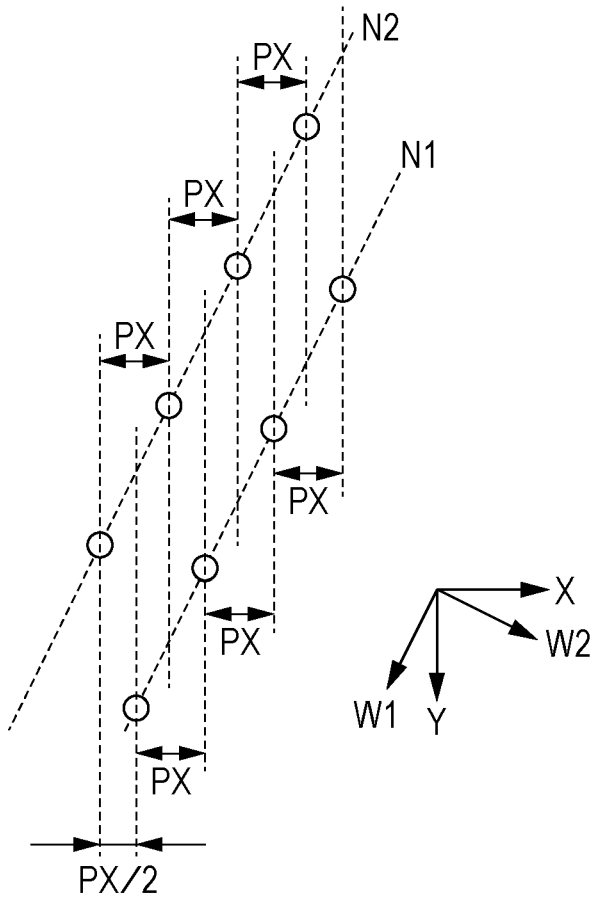
FIG. 11 is an explanatory diagram of an array of a plurality of nozzles according to a modification example.

(3) In each aspect described above, a configuration is exemplified in which each nozzle N of the first nozzle row N1 and each nozzle N of the second nozzle row N2 have a common position in the X direction, but the position of each nozzle N is not limited to the above exemplification. For example, as exemplified in FIG. 11, it is also possible to make the positions of each nozzle N of the first nozzle row N1 and each nozzle N of the second nozzle row N2 different in the X direction. In FIG. 11, a configuration is exemplified in which the position of each nozzle N of the first nozzle row N1 and each nozzle N of the second nozzle row N2 are made different in the X direction by half of the pitch PX (PX/2) of each nozzle N in the X direction of the first nozzle row N1 (or the second nozzle row N2).

According to the configuration of FIG. 11, in comparison to the configuration in which the plurality of nozzles N are arranged as exemplified in FIG. 4, it is possible to increase (double) the practical dot density in the X direction of the medium 12.

Figure 12:
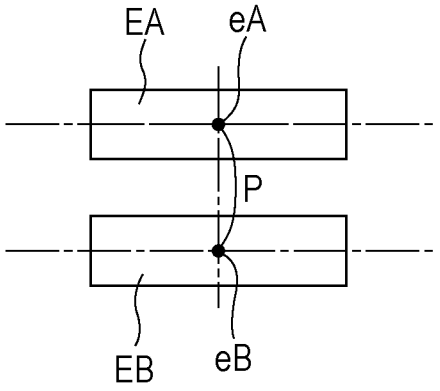
FIG. 12 is an explanatory diagram of a pitch in an array of a plurality of electrodes.

(4) A pitch P of the array of the plurality of electrodes E is defined as the distance between the centers of each of the electrodes E which are adjacent to one another. For example, as exemplified in FIG. 12, when focusing on an electrode EA and an electrode EB which are adjacent to one another, the distance between a center (center of gravity) eA of the electrode EA and a center eB of the electrode EB is equivalent to the pitch P. The centers e (eA and eB) of each electrode E, for example, are defined as intersection points between a center line along a direction (longitudinal direction) in which the electrodes E extend and a center line in the width direction of the electrodes E, and the form and the direction of each of the electrodes E is not relevant.

(5) The components which vary the pressure inside the pressure chamber SC (the driving elements F) are not limited to the piezoelectric elements exemplified in each aspect described above. For example, it is also possible to utilize an oscillator such as an electrostatic actuator as the driving elements F. In addition, the driving elements F are not limited to components which impart mechanic vibration to the pressure chambers SC. For example, it is also possible to utilize a heat generating element (heater) which, varies the pressure by generating bubbles inside the pressure chambers SC by heating, as the driving element F. As understood from the exemplification above, the driving elements F are included as components (pressure generating elements) which impart pressure inside the pressure chambers SC, and neither the method by which pressure is imparted (piezo system/thermal system) nor the detailed configuration are relevant.

(6) It is possible to adopt the printing apparatus 10 which is exemplified in each of the aspects above in various devices other than a device which is specialized for printing such as a facsimile apparatus or a copy machine. However, the applications of the liquid ejecting apparatus of the invention are not limited to printing. For example, a liquid ejecting apparatus which ejects color liquid is utilized as a manufacturing apparatus which forms a color filter of a liquid crystal display apparatus. In addition, a liquid ejecting apparatus which ejects a conductive material solution is utilized as a manufacturing apparatus which forms an electrode and a wiring of a wiring substrate.

What is claimed is:

1. A liquid ejecting head comprising:

driving elements configured to cause liquid to be ejected from nozzles by imparting pressure to pressure chambers filled with the liquid; and electrodes each extending along a second direction in a mounting region where an electric wiring is set, wherein the driving elements include: first driving elements arranged along a first direction intersecting the second direction, and second driving elements arranged along the first direction at the opposite side to the first driving elements with the mounting region interposed therebetween, wherein the plurality of electrodes include:

first electrodes arranged along the first direction in a first region within the mounting region and are electrically connected to the first driving elements;

second electrodes arranged along the first direction across the first region and a second region within the mounting region and are electrically connected to the second driving elements, the second region is positioned at one side in the first direction viewed from the first region; and a third electrode not configured to contribute to ejection of the liquid and is formed between each of the second electrodes that are adjacent to one another along the first direction in the second region, wherein, within the first region, the first electrodes and the second electrodes overlap each other in the second direction.

2. The liquid ejecting head according to claim 1, wherein the electric wiring is a flexible wiring board on which a plurality of connection terminals are formed, and is fixed in the mounting region using an adhesive, the terminals being electrically connected to the first electrodes and the second electrodes.

3. A liquid ejecting apparatus comprising the liquid ejecting head according to claim 2.

4. The liquid ejecting head according to claim 1, further comprising:

a structure including a first wall surface positioned between the mounting region and the driving elements in planar view, and a second wall surface positioned between the mounting region and the second driving elements in planar view.

5. A liquid ejecting apparatus comprising the liquid ejecting head according to claim 4.

6. The liquid ejecting head according to claim 1, wherein a pitch at which one of the first electrodes and one of the second electrodes are arranged within the first region, and a pitch at which one the second electrodes and the third electrode are arranged within the second region are equal pitches.

7. The liquid ejecting head according to claim 6, wherein a plurality of third electrodes are arranged at the pitch along the first direction at an opposite side to the first region in the second region.

8. A liquid ejecting apparatus comprising the liquid ejecting head according to claim 7.

9. A liquid ejecting apparatus comprising the liquid ejecting head according to claim 6.

10. The liquid ejecting head according to claim 1, further comprising:

fourth electrodes that are formed on the same layer as the first driving electrodes at an opposite side to another end section that interposes one end section in an array of the first driving elements, wherein each of the driving elements includes a first driving electrode, a piezoelectric body which is formed on an upper surface of the first driving electrode in a process including heat treatment, and a second driving electrode which is formed on an upper surface of the piezoelectric body, the first electrode is electrically connected to the first driving electrode of the first driving element, and the second electrode is electrically connected to the first driving electrode of the second driving element.

11. A liquid ejecting apparatus comprising the liquid ejecting head according to claim 10.

12. The liquid ejecting head according to claim 1, wherein an interval between the first driving electrode of the first driving element and the first driving electrode of the second driving element is wide in comparison to the range in which the fourth electrodes are distributed along the first direction.

13. A liquid ejecting apparatus comprising the liquid ejecting head according to claim 12.

14. The liquid ejecting head according to claim 1, wherein the range in which the first electrodes are present along the second direction, and the range in which the second electrodes are present along the second direction overlap with one another in the second direction.

15. The liquid ejecting head according to claim 1, wherein a virtual line that links a nozzle corresponding to a first driving element which is positioned at an end section at one side in the first direction among the first driving elements, and a nozzle corresponding to a second driving element which is positioned at an end section at one side in the first direction among the second driving elements is inclined at an angle within the range of 30° to 60° inclusive in the first direction.

16. A liquid ejecting apparatus comprising the liquid ejecting head according to claim 1.

17. The liquid ejecting head according to claim 1, further comprising another third electrode not configured to contribute to ejection of the liquid and formed between each of the first electrodes that are adjacent to one another along the first direction in a third region of the mounting region, the third region and the second region being disposed at opposite respective ends of the first region.

18. A liquid ejecting head comprising:

driving elements configured to cause liquid to be ejected from nozzles by imparting pressure to pressure chambers filled with the liquid; and electrodes each extending along a second direction in a mounting region where an electric wiring is set, wherein the driving elements include: first driving elements arranged along a first direction intersecting the second direction, and second driving elements arranged along the first direction at the opposite side to the first driving elements with the mounting region interposed therebetween, wherein the plurality of electrodes include:

first electrodes arranged along the first direction in a first region within the mounting region and are electrically connected to the first driving elements;

second electrodes arranged along the first direction across the first region and a second region within the mounting region and are electrically connected to the second driving elements, the second region is positioned at one side in the first direction viewed from the first region; and a third electrode not configured to contribute to ejection of the liquid and is formed between each of the second electrodes that are adjacent to one another along the first direction in the second region, wherein, within the first region, the first electrodes and the second electrodes are interleaved with each other in the first direction.

19. A liquid ejecting head comprising:

driving elements configured to cause liquid to be ejected from nozzles by imparting pressure to pressure chambers filled with the liquid; and electrodes each extending along a second direction in a mounting region where an electric component is set, wherein the plurality of electrodes include:

first electrodes arranged along a first direction in a first region within the mounting region, the first direction intersecting the second direction, the first electrodes extending from the mounting region to a first side of the second direction and electrically connected to first driving elements of the driving elements;

second electrodes arranged along the first direction across the first region and a second region within the mounting region, extending from the mounting region to a second side opposite of the first side and electrically connected to second driving elements of the driving elements, the second region is positioned at one side in the first direction viewed from the first region, the second driving elements positioned at the one side in the first direction viewed from the first driving elements; and a third electrode not configured to contribute to ejection of the liquid and is formed between each of the second electrodes that are adjacent to one another along the first direction in the second region, and wherein, within the first region, the first electrodes and the second electrodes overlap each other in the second direction.

20. A liquid ejecting head comprising:

driving elements configured to cause liquid to be ejected from nozzles by imparting pressure to pressure chambers filled with the liquid; and electrodes each extending along a second direction in a mounting region where an electric component is set, wherein the plurality of electrodes include:

first electrodes arranged along a first direction in a first region within the mounting region, the first direction intersecting the second direction, the first electrodes extending from the mounting region to a first side of the second direction and electrically connected first driving elements to the driving elements;

second electrodes arranged along the first direction across the first region and a second region within the mounting region, extending from the mounting region to a second side opposite of the first side and electrically connected to second driving elements of the driving elements, the second region is positioned at one side in the first direction viewed from the first region, the second driving elements positioned at the one side in the first direction viewed from the first driving element; and a third electrode not configured to contribute to ejection of the liquid and is formed between each of the second electrodes that are adjacent to one another along the first direction in the second region, and wherein, within the first region, the first electrodes and the second electrodes are interleaved with each other in the first direction.

* * * * *